United States Patent [19]

Corrado

[11] 3,956,993

[45] May 18, 1976

[54] FLUID EXPLOSIVE INITIATOR

[75] Inventor: Anthony P. Corrado, Totowa Boro, N.J.

[73] Assignee: The United States of America as represented by the Secretary of the Army, Washington, D.C.

[22] Filed: Nov. 8, 1974

[21] Appl. No.: 522,155

[52] U.S. Cl. ..... 102/81; 102/78

[51] Int. Cl.[2] ..... F42C 5/00

[58] Field of Search ..... 102/81, 78, 77

[56] References Cited

UNITED STATES PATENTS

| | | | |
|---|---|---|---|
| 1,545,866 | 7/1925 | Van Essen | 102/77 |
| 3,277,825 | 10/1966 | Maillard | 102/81 X |
| 3,362,332 | 1/1968 | Campagnuolo | 102/81 |
| 3,578,011 | 5/1971 | Holmes | 102/81 UX |
| 3,630,151 | 12/1971 | Rakowsky | 102/81 X |
| 3,672,300 | 6/1972 | Axelson | 102/81 X |
| 3,854,401 | 12/1974 | Fisher | 102/81 X |

*Primary Examiner*—David H. Brown

*Attorney, Agent, or Firm*—Nathan Edelberg; A. Victor Erkkila; Max Yarmovsky

[57] ABSTRACT

The setback force of a gun launch environment is used to help arm a projectile fuze by shearing a pin which holds a slidable nozzle in a non-operative position. The sheared pin permits the nozzle to move into an operative position adjacent to a heat producing resonance tube. A second arming function is performed when the velocity of the launched projectile causes air to push a spring biased out-of-line detonator into alignment with the heat producing resonance tube. Ram air which is forced into the resonance tube by the high speed of the projectile creates shock waves which generate heat which ignite the detonator.

3 Claims, 4 Drawing Figures

FLUID EXPLOSIVE INITIATOR

GOVERNMENTAL INTEREST

The invention described herein may be manufactured, used and licensed by or for the Government for governmental purposes without the payment to me of any royalty thereon.

BACKGROUND OF THE INVENTION

Various means have been used in the prior art which are responsive to the normal acceleration environment of a projectile flight in order to ensure that the projectile has been properly launched from the gun as against the possible inadvertent exposure to an environment which merely simulates launch conditions. Prior art devices which seek to achieve safety of a munition by preventing premature arming without the use of electrical components, generally use mechanical clock type mechanisms or a complex system involving levers and gears. The aforementioned prior art devices are not only expensive to manufacture because of their complexity, but also require special care in storage. In prior art mechanical fuzes it is important, for proper subsequent operation of the device, to control the storage environment in order to prevent corrosion damage to delicately meshed gear train mechanisms and low friction pivoted levers.

SUMMARY OF THE INVENTION

The present invention relates to a fuzing device for a gun launched projectile which uses the gun barrel launch environment as well as the flight environment to provide safing and arming functions. The present invention utilizes two relatively simple to manufacture sliding members in combination with a resonance tube, shear pin, and biasing means to safe arm and fire a detonator which in turn ignites a high explosive lead train.

An object of the present invention is to provide a fluid explosive initiator which utilizes the setback force of a gun environment and the flight environment to arm and fire a projectile.

Another object of the present invention is to provide a fluid explosive initiator which utilizes only a few simple to manufacture sliding parts which are inexpensive to manufacture and reliable in operation.

Another object of the present invention is to provide a fluid explosive initiator which is least likely to be accidently activated by shock environment other than that found in a normal gun launch.

A further object of the present invention is to provide a fluid explosive initiator which utilizes a resonance tube to generate the energy to actuate a detonator.

For a better understanding of the present invention, together with other and further objects thereof, reference is made to the following descriptions taken in connection with the accompanying drawings.

BRIEF DESCRIPTION OF THE DRAWINGS

Throughout the following description like reference numerals are used to denote like parts of the drawings.

DESCRIPTION OF THE PREFERRED EMBODIMENTS

Figure 2:
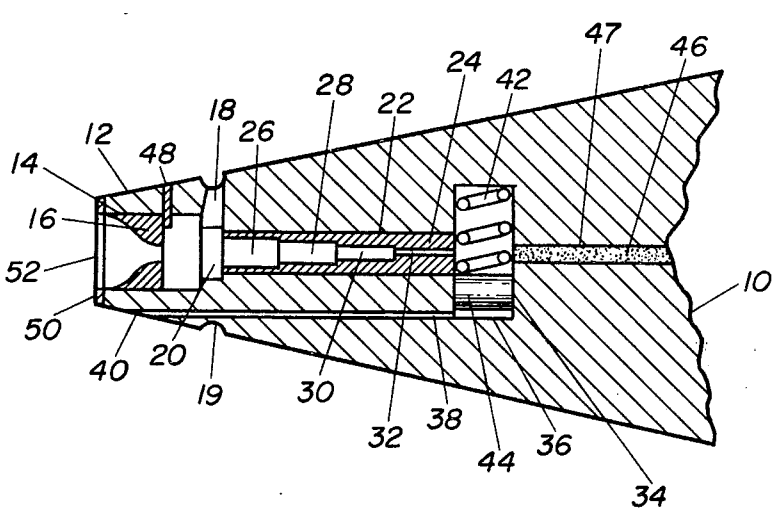
FIG. 2 is a cutaway longitudinal cross-sectional view, taken along line 2—2 of FIG. 1, showing the fuze in a "safe" position.
Figure 1:
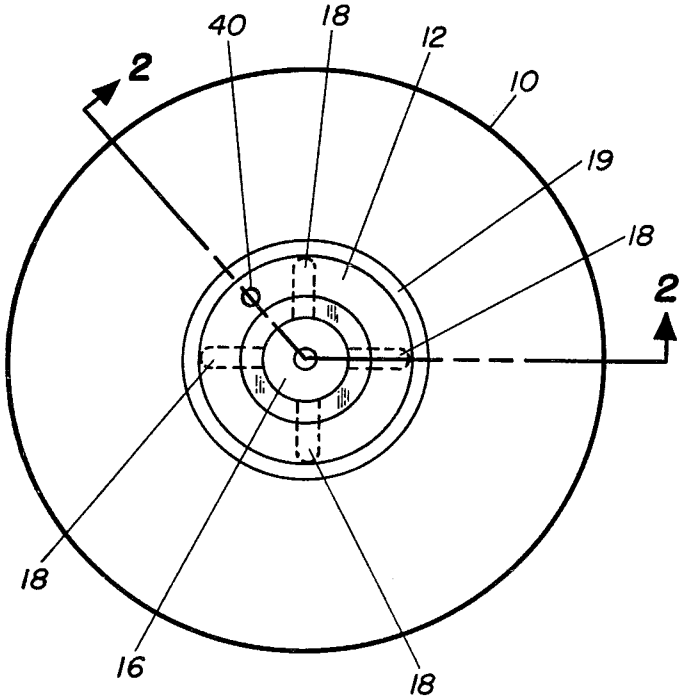
FIG. 1 is a plan view of the nose end of a projectile body.
Figure 4:
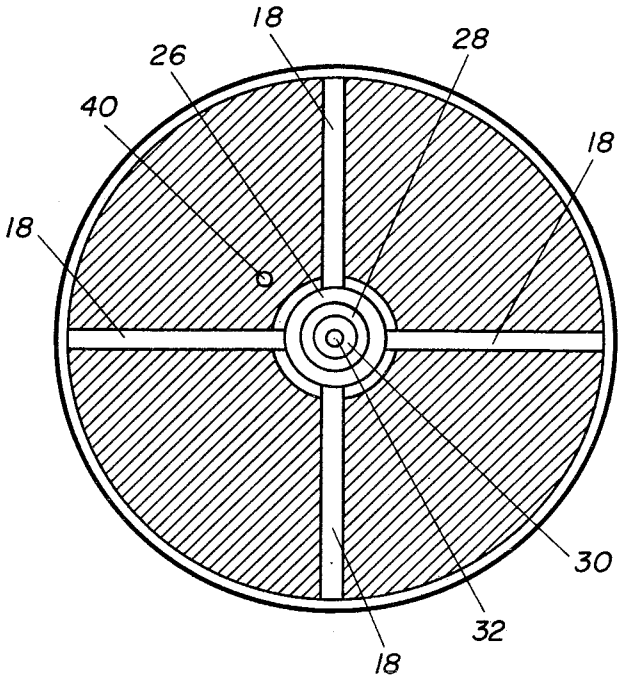
FIG. 4 is an enlarged cross-sectional view taken along line 4—4 of FIG. 3.

Referring now to FIGS. 1, 2 and 4, fuze body 10 has a conically shaped forward open nozzle end 12 which contains an axial nozzle counterbore 14 which holds a slidable nozzle 16 therein. A plurality of radially positioned vent bores 18 are placed in an annular groove 19. The bores 18 communicate with nozzle counterbore 14 through an axially aligned flash hole 20 which has a diameter smaller than the diameter of the nozzle counterbore 14. The vent bores 18 permit some of the ram air to escape and are placed in the groove 19 in order that a substantial differential of pressure may be created in the fore and aft throat sections of nozzle 16. An axially positioned resonance tube body bore 22 contains a resonance tube 24 which has three progressively sized axial counterbores 26, 28 and 30 therein. The largest resonance tube counterbore 26 communicates with flash hole 18. The smallest counterbore 30 communicates with resonance tube bore 32. A transversely positioned, tubularly shaped detonator slide cavity 34 communicates on one end 36 with a longitudinally positioned air passageway 38 which has an input orifice 40 which is positioned near the nozzle end 12 of fuze body 10. In the "safe" position, as shown by FIG. 1, a biased helical coil spring 42 keeps detonator 44 out-of-line with respect to resonance tube 24 and out-of-line with explosive lead train 46 which is located in axial lead train bore 47. When the fuze is in a "safe", unarmed, position a shear pin 48 keeps slidable nozzle 16 in its non-operative position. An annularly shaped cover plate 50 having a central orifice 52 therein is fixed to nozzle end 12. The plate 50 allows air to enter nozzle 16 while retaining the nozzle 16 within nozzle counterbore 14.

Figure 3:
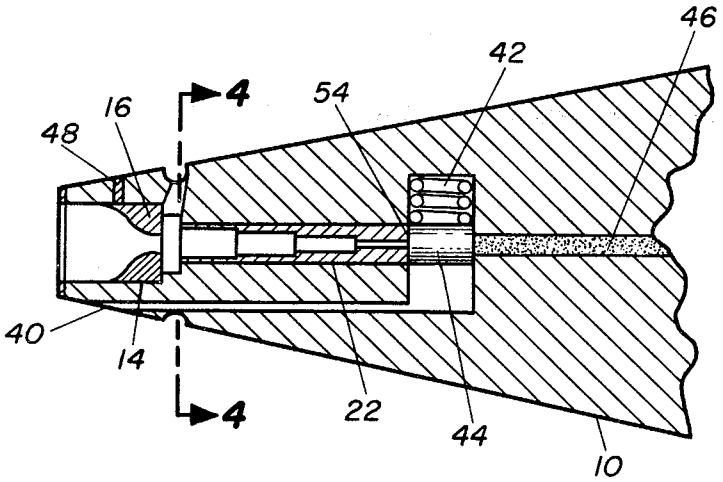
FIG. 3 is a cutaway longitudinal cross-sectional view, taken along line 2—2 of FIG. 1, showing the fuze in an "armed" position.

Referring now to FIGS. 1 and 3, in operation, prior to launching of the projectile, the nozzle 16, as shown in FIG. 1, is in its forward most position. The high explosive lead train 46 in the "safe" position is out-of-line with the detonator 44. Upon firing of the projectile the setback force of a normal launch acting upon the nozzle 16 causes the nozzle 16 to cut shear pin 48. The released nozzle 16 is thus free to be rearwardly driven into its operative position, as shown in FIG. 3. It is the function of the resonance tube 24 to take the impacting shock waves from the ram air coming through the nozzle 16 and to convert it to heat energy at the bottom end 54 of the resonance tube 24. During launch, while the projectile is in the barrel of the gun, the combination of the setback force, frictional force, and the biasing force of spring 42 on the detonator 44 are sufficient to overcome the counter force exerted on the detonator 44 by the ram air entering air passageway 38 through input orifice 40. The incoming ram air entering cavity 34 through resonance tube bore 32 during barrel travel creates an air pressure force acting on detonator 44 which is substantially less than the air pressure force acting on the other side of detonator 44 through passageway 38 and orifice 40, because a substantial portion of the ram air entering flash hole 20, which is not used to generate heat is expelled through vent bores 18. The detonator 44 is kept out of alignment with the lead train 46 until such time as the ram air pressure entering air passageway 38, through input orifice 40, is sufficient to cause the detonator 44 to move and overcome the biasing force of coil spring 42. This movement of the detonator 44 occurs after the projectile has exited from the muzzle of the gun, after setback force has decayed substantially, and at a time that sufficient temperature is generated at the bottom end 54 of the resonance tube 24. The ignition of the lead train 46 completes the fuzing process.

The foregoing disclosure and drawings are merely illustrative of the principles of this invention and are not to be interpreted in a limiting sense. I wish it to be understood that I do not desire to be limited to the exact details of construction shown and described for obvious modifications will occur to a person skilled in the art.

Having thus fully described the invention, what is claimed as new and desired to be secured by Letters Patent is:

1. A fluid explosive initiator for safing and arming a projectile which comprises:

a fuze body having a conically shaped forward open nozzle end, said open nozzle end having an axially positioned nozzle counterbore therein which communicates with an axially aligned flash hole of smaller diameter than said nozzle counterbore, said flash hole communicates with an axially positioned resonance tube body bore, said body bore communicates with a transversely positioned, tubularly shaped detonator slide cavity, said slide cavity communicating with an axially positioned lead train bore, said slide cavity being connected on one end to a longitudinally positioned air passageway which has an input orifice positioned near said nozzle end, said nozzle end having an annular groove therein which communicates with said flash hole through a plurality of radially positioned vent bores;

a nozzle releasably positioned in said nozzle counterbore;

restraining means for fixedly holding said nozzle in a "safe" inoperative position until said projectile has experienced the setback forces of a normal launch;

a cover plate having a central orifice therein fixedly positioned on said nozzle end over said nozzle coounterbore for holding said nozzle within said nozzle counterbore;

a lead train located in said lead train bore;

detonator means biasedly and slidably disposed in said slide cavity for igniting said lead train said detonator means being biasedly held in a "safe" out-of-line position prior to projectile launch and being moved to an in-line "armed" position when said projectile has been launched; and fluid heat generating means for igniting said detonator means when said projectile velocity has increased sufficiently to move said detonator means from said out-of-line "safe" position to said in-line "armed" position.

2. A fluid explosive initiator as recited in claim 1 wherein said detonator means includes:

a detonator slidably positioned in said slide cavity; and a helical coil spring positioned in said slide cavity for biasedly holding said detonator out of alignment with fluid heat generating means when said projectile is in a "safe" position and for allowing said detonator to move into alignment with said fluid heat generating means when said projectile is in an "armed" position.

3. A fluid explosive initiator as recited in claim 1 wherein said heat generating means comprises a resonance tube having a plurality of decreasingly sized counterbores axially positioned therein, the largest of said sized counterbores being positioned adjacent said flash hole and in alignment with said nozzle, the smallest of said sized counterbores being positioned so that it is in alignment with said detonator, when said projectile is in said "armed" position.

* * * * *